United States Patent [19]

Chen et al.

[11] Patent Number: 5,012,666

[45] Date of Patent: May 7, 1991

[54] CRIMP TOOL WITH ADJUSTABLE JAW

[76] Inventors: Ching-Wen Chen, No. 29-1, Luh-Tyi St.; Ching-Jen Chen, No. 33-1, Luh-Tyi-St., both of Panchiao City, Taipei Hsien, Taiwan

[21] Appl. No.: 384,309

[22] Filed: Jul. 24, 1989

[51] Int. Cl.[5] ..... B21D 7/06; H01R 43/042

[52] U.S. Cl. ..... 72/410; 29/751; 81/313; 81/382; 81/402

[58] Field of Search ..... 72/409, 410; 81/109, 81/106, 313, 383, 382, 408, 402, 403, 411, 406; 29/751

[56] References Cited

U.S. PATENT DOCUMENTS

| | | | |
|---|---|---|---|
| 228,333 | 6/1880 | Fawcett | 81/406 |
| 244,269 | 7/1881 | Lovrien | 81/402 |
| 338,326 | 3/1886 | Wilson | 81/382 |
| 485,152 | 10/1892 | Cook | 81/383 |
| 1,114,649 | 10/1914 | Reed | 81/384 |
| 2,399,454 | 4/1946 | Snell | 81/402 |
| 3,204,445 | 9/1965 | Filia | 72/410 |
| 4,559,805 | 12/1985 | McClure | 72/409 |
| 4,608,888 | 9/1986 | Rommel | 81/313 |
| 4,794,780 | 1/1989 | Battenfeld | 81/313 |

*Primary Examiner*—Daniel C. Crane

*Attorney, Agent, or Firm*—Ashen Martin Seldon Lippman & Scillieri

[57] ABSTRACT

A crimp tool includes a first handle, a head member pivoted to the front portion of the first handle to serve as a clamping member, and a second handle pivoted to the head member. The second handle is connected to the first handle through a mechanism which urges the second handle and the head member to the releasing position thereof. An adjustment member for the jaws of the crimp tool includes an adjustment screw rod and two nuts to adjust the position of a pivot pin in an oblong pivot hole which pivots the head member to the first handle member so that conductors of different cross-sections can be crimped effectively.

3 Claims, 6 Drawing Sheets

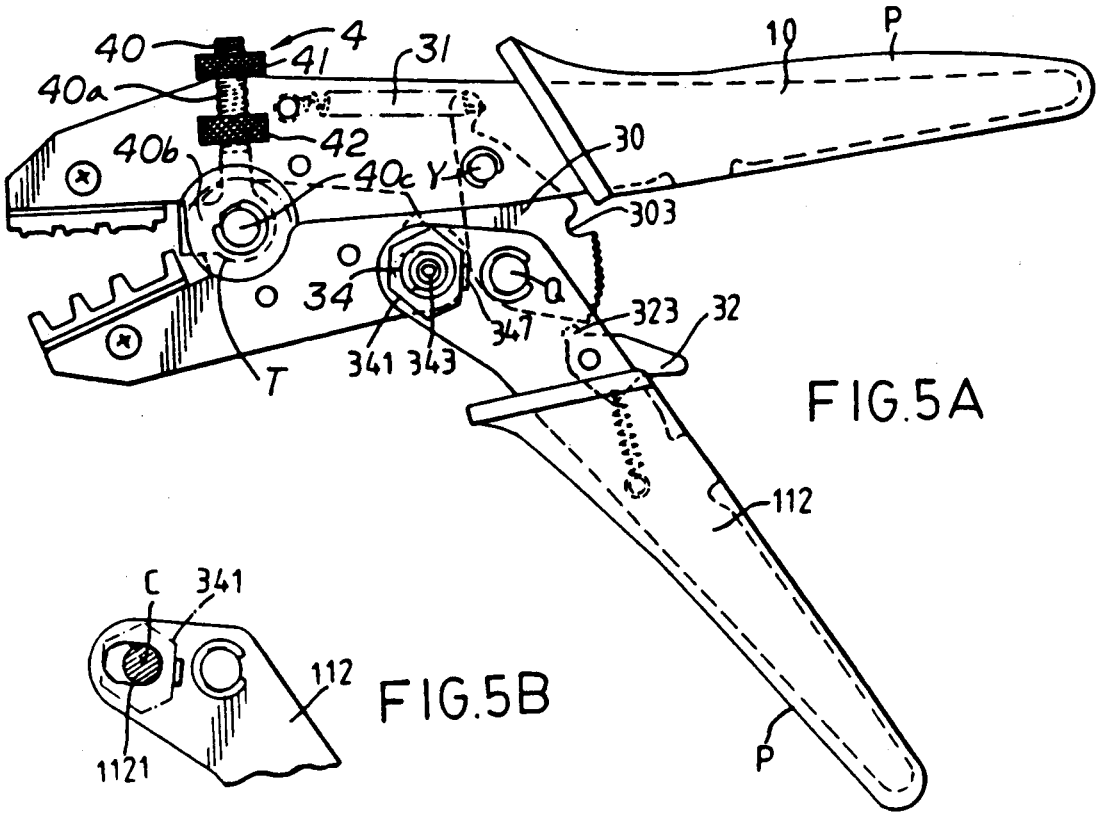
FIG.5A
FIG.5B
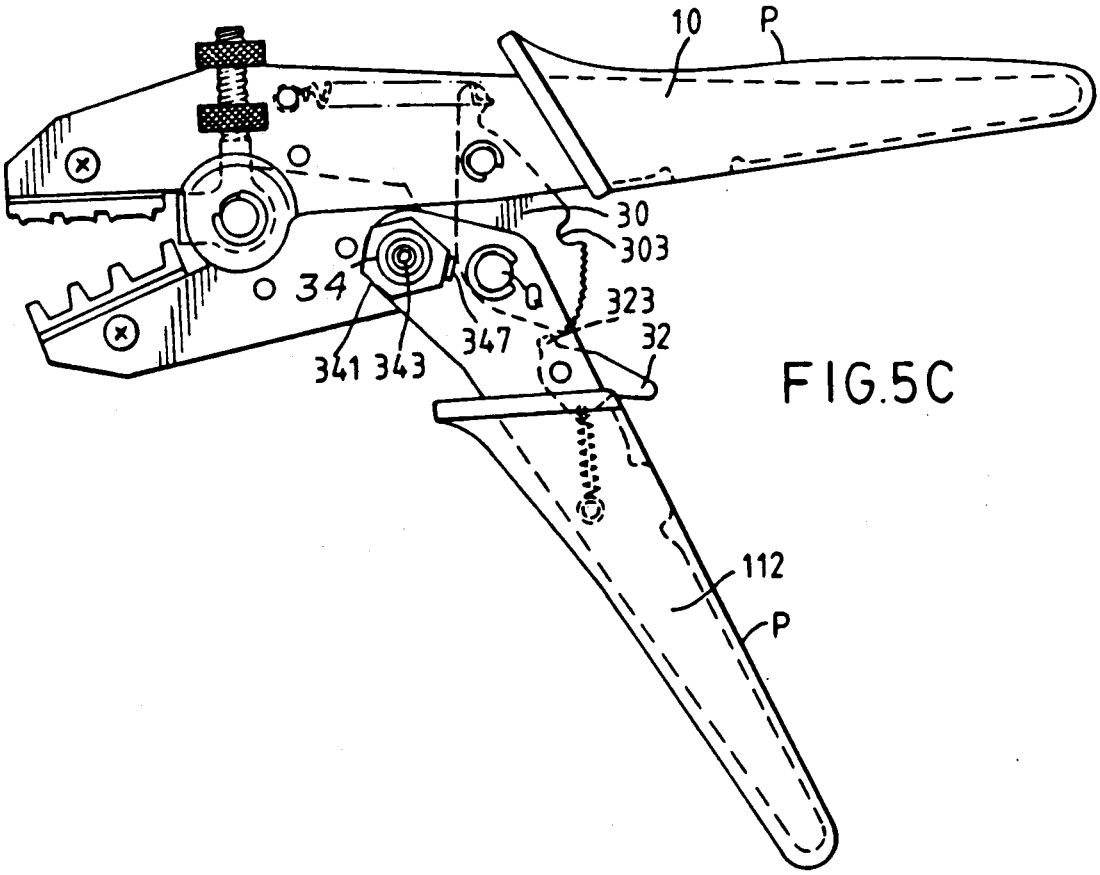
FIG.5C

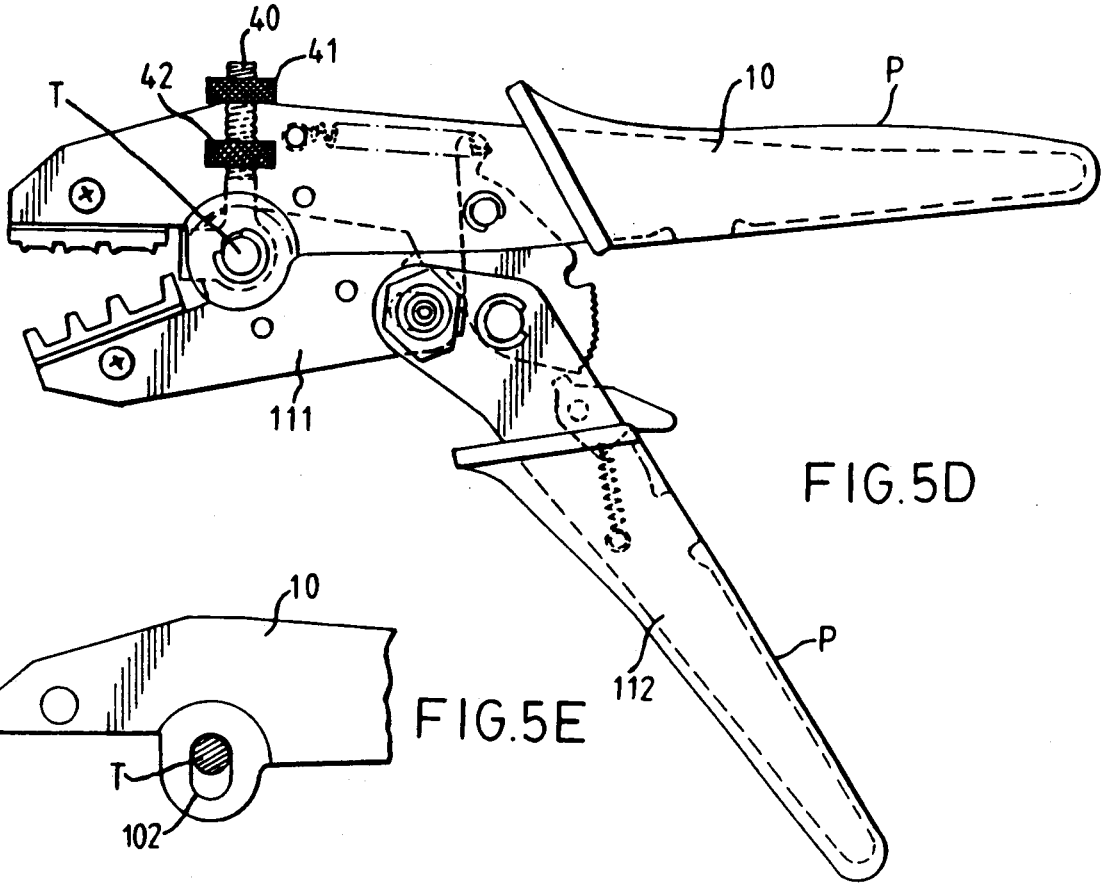
FIG.5D
FIG.5E
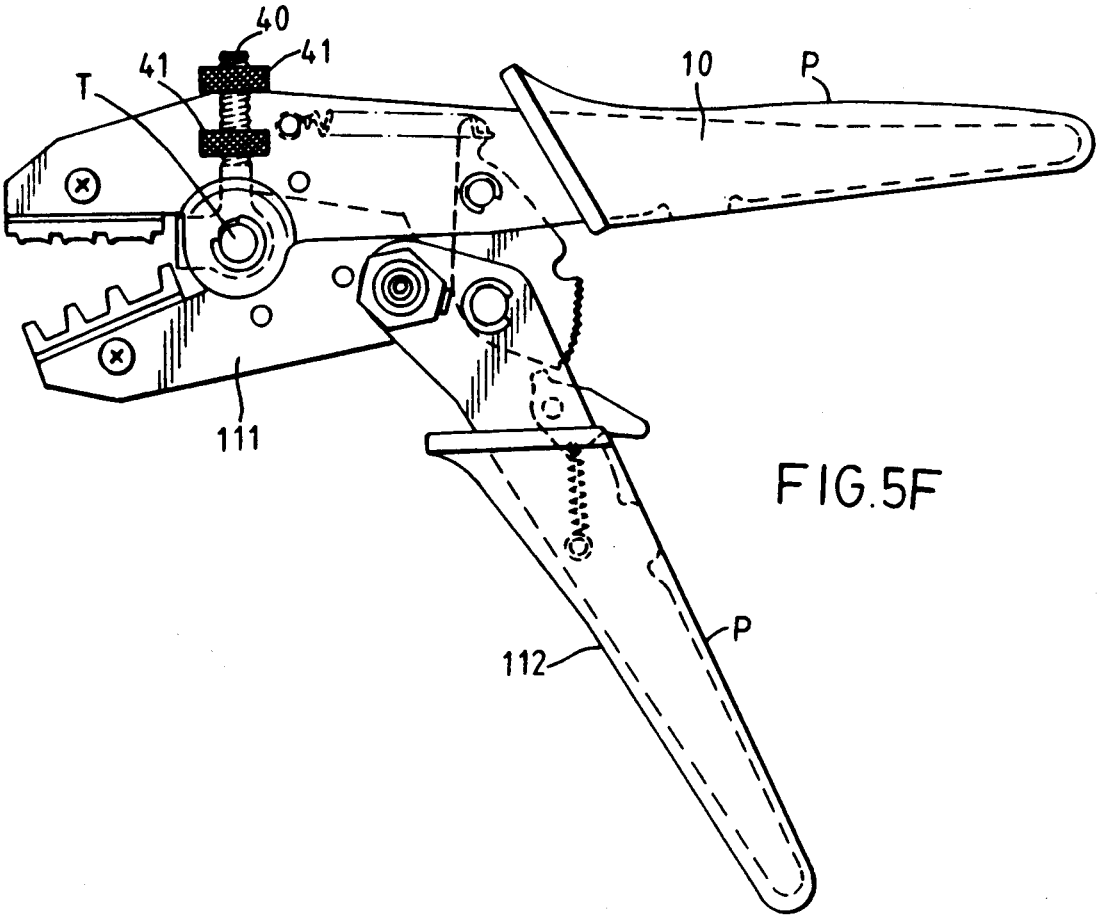
FIG.5F

CRIMP TOOL WITH ADJUSTABLE JAW

BACKGROUND OF THE INVENTION

This invention relates to a crimp tool for crimping a conductor together with a terminal, and particularly to a crimp tool having an adjustment member to adjust the jaws thereof.

It is a common practice to connect a conductor to a terminal device shown in FIG. 1 or 2 by using a crimp tool which has clamping jaw members shown in FIGS. 2A or 2B. A conventional crimp generally includes two clamping members movable between a clamping position and a releasing position and two handle members connected to the clamping members. The clamping members may incorporate either one of the jaw members shown in FIGS. 2A and 2B. Since the wire and the terminal are slightly resilient, in many cases, a tight engagement is not achieved therebetween after they are released from the conventional crimp tool. This is because the clamping members of the conventional crimp tool move to the releasing position as soon as the pressure on the handles is released. It is necessary to apply a sufficient pressure on the handles until the wire and the terminal are engaged firmly with each other. Moreover, the clamping jaws of the conventional crimp tools are found to be ineffective when they are used for a conductor with a large cross-section since, in this case, the clamping face of the jaws cannot be in a parallel relationship with the face of the object therebetween and thus the object cannot be crimped effectively.

Many improvements have been made in the crimp tools. One of the improved crimp tools includes a ratchet-and-pawl mechanism which prevents the handles of the tool from moving to their released position after the handles are squeezed and the pressure applied thereon is removed.

SUMMARY OF THE INVENTION

A main object of the present invention is to provide a crimp tool with an adjustment device to adjust the jaws of the tool so that the jaws are adaptable to crimp a variety of conductors.

The invention provides an improvement in a crimp tool which includes a one piece elongated first handle member having a front portion with a first pivot hole and a rear portion, a head member pivoted to the front portion for moving between a clamping position and a releasing position with respect to the front portion, the head member having a second pivot hole to be aligned with the first pivot hole, a first pivot pin member passing through the first and second pivot holes, a second elongated handle member pivoted to the head member for moving between a clamping position and a releasing position with respect to the rear portion of the first handle member, the second handle member moving the head member relative to the front portion when the second handle member is moved, the second handle member having a fourth pivot hole to be aligned with the third pivot hole, a second pivot pin which passes through the third and fourth pivot holes, means for biasing the second handle member to a releasing position, and two jaw members attached respectively to the front portion and the head member. The improvements are those in which the first pivot hole is oblong in the direction of the movement of the head member, the first pivot pin is movable in the oblong first pivot hole, the front portion of the first handle member is further provided with a slot near the first pivot hole. The improvements further include an adjustment rod member extending in the head member in the direction of the first oblong pivot hole and having a screw thread thereon and a bore to be aligned with the first and second pivot holes, the first pivot pin passing through the bore. The improvements still further include two adjustment nuts sleeved around the adjustment rod, one of the adjustment nuts being received in the slot and the other one being adjacent one edge of the front portion of the first handle member, the position of the first pivot pin in the first pin hole being adjustable by turning one of the adjustment nuts.

In another aspect of the invention, the third pivot hole is an oblong pivot hole, the second pivot pin is movable in the third pivot hole and provided with a threaded axial bore, the crimp tool further having a means for adjustably positioning the second pivot pin in the third pivot hole, the means being characterized by a hollow rotary adjustment knob having a flanged end, an insert pin inserted into the hollow rotary adjustment member and secured to the threaded axial bore of the second pivot pin, and a helical spring sleeved around the insert pin, the flanged end being formed with engaging members at different distances from the axis of the second pivot pin, the second handle member being formed with an engaging boss adjacent to the flanged end, the spring biasing the rotary hollow adjustment knob so as to cause said flanged end to engage with said boss, the flanged end being disengaged from the boss when the knob is pulled outward against the action of the spring.

The present exemplary preferred embodiment will be described in detail with reference to the accompanying drawings, in which:

BRIEF DESCRIPTION OF THE DRAWINGS

FIGS. 5A to 5F shows the operation of the crimp tool of the present invention.

DETAILED DESCRIPTION OF THE PREFERRED EMBODIMENTS

Figure 3:
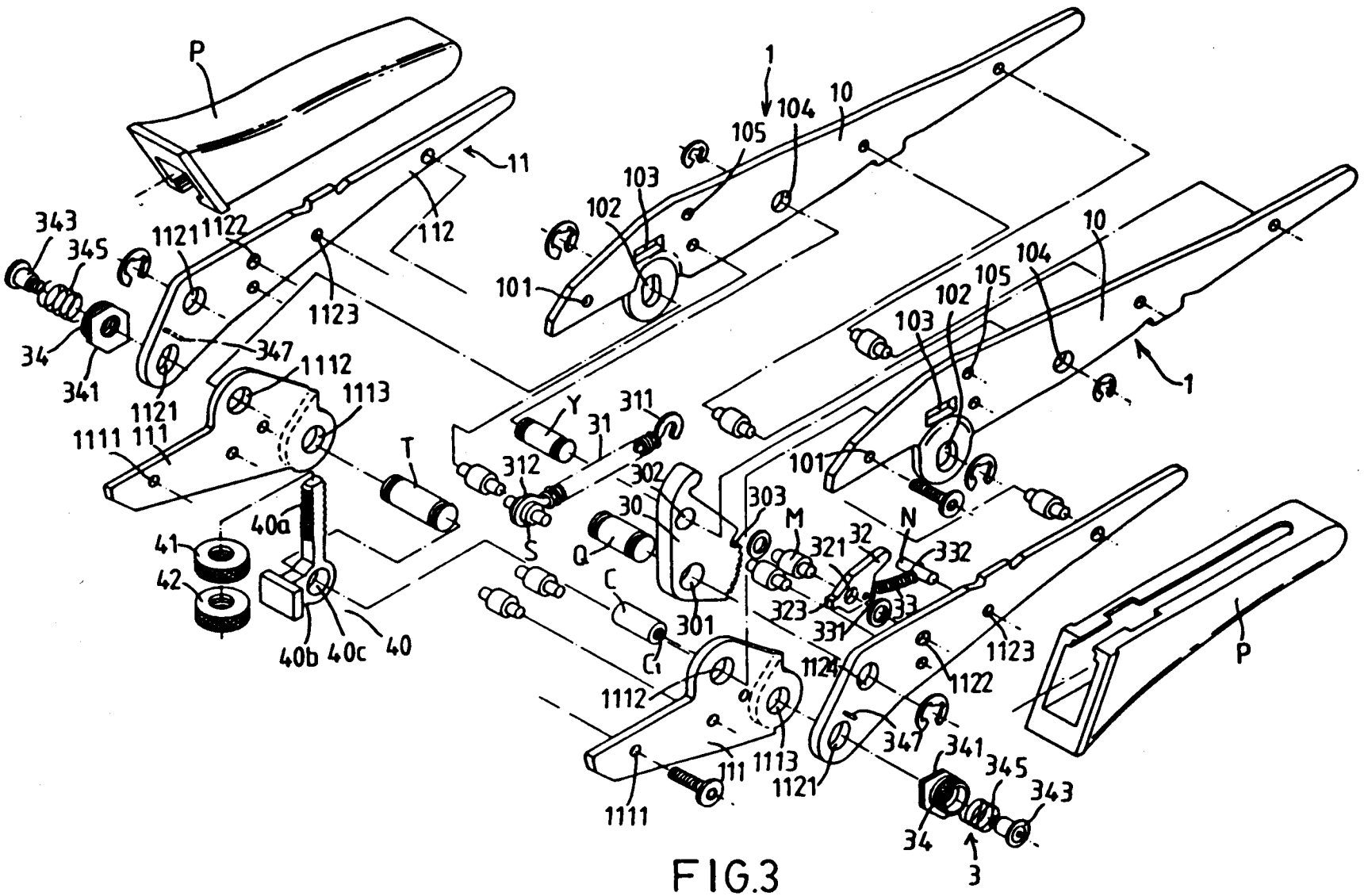
FIG. 3 is an exploded view a crimp tool incorporating the present invention.
Figure 4:
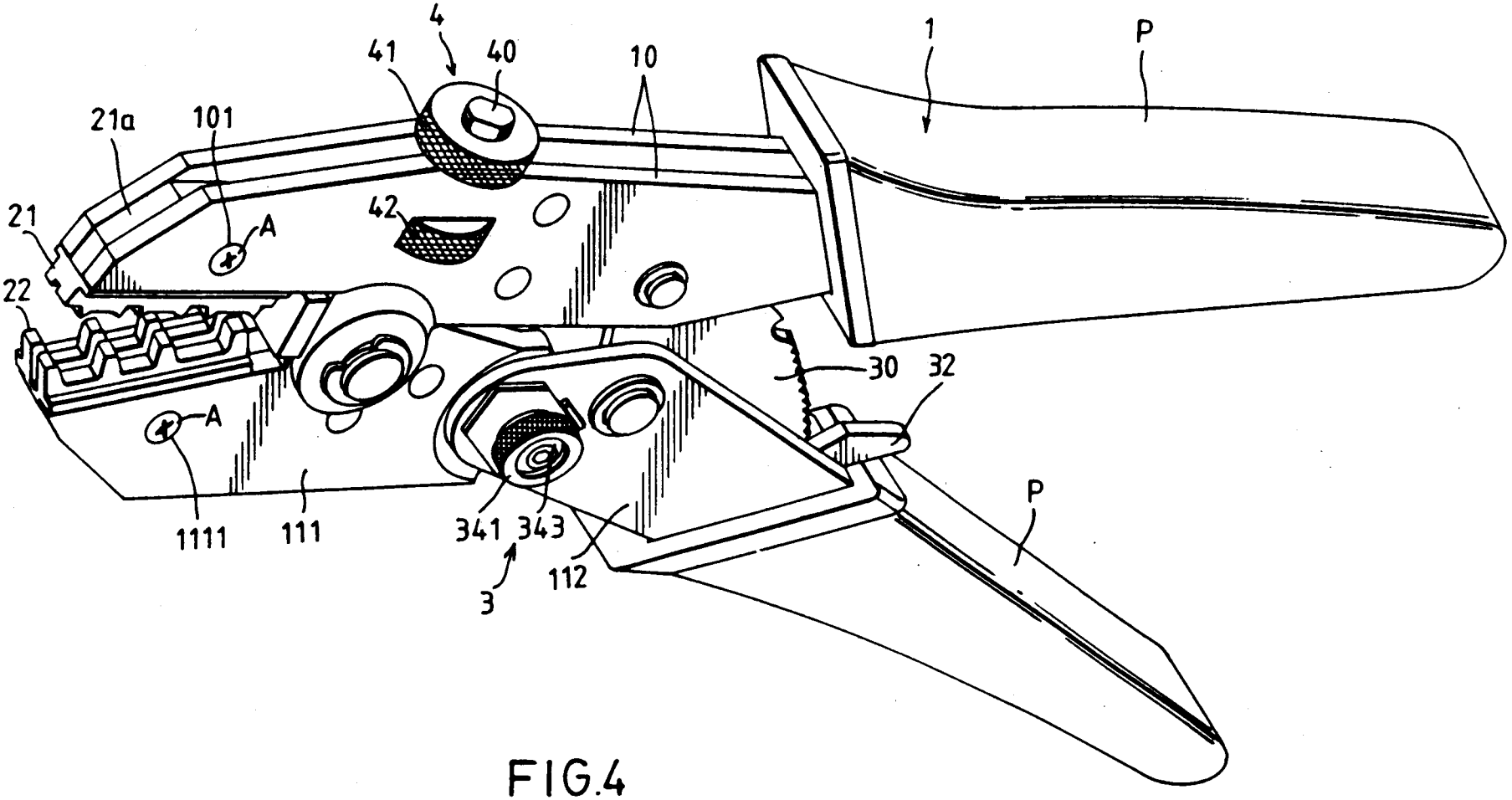
FIG. 4 is a perspective view of the crimp tool of FIG. 3.

Referring to FIGS. 3 and 4, a crimp tool according to the present invention is shown, including a handle assembly 1 which has two first handle plates 10 which are secured to one another by means of screw connection. The handle assembly 1 further includes a pair of second handle plates 112 which are secured together by means of screw connection. The head plates 111 are pivoted to a front portion of the handle plates 10 by means of a pin T which passes through holes 1112 of the head plates 111 and oblong holes 102 of the handle plates 10. The head plates 111 can be moved towards and away from the front portion of the handle plates 10 so as to serve as a clamping member in connection with the handle plates 10. The handle plates 112 are pivoted to the head plates 111 and provided with oblong or elliptical pivot holes 1121 for the insertion of a pivot C carrying two adjustment mechanisms 3 which will be described hereinafter. The handle plates 10 are further provided with rectangular holes 103 above the holes 102 for receiving an adjustment nut of an adjustment mechanism 4 which will be detailed hereinafter. Both pairs of handle plates 10 and 112 are covered by plastic handle grips P.

Figure 1B:
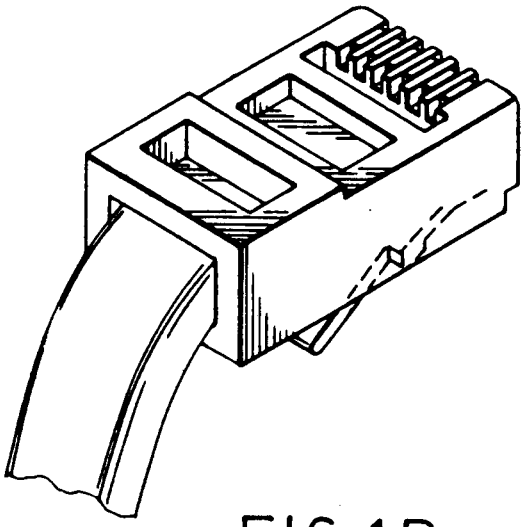
FIG. 1B PRIOR ART
FIGS. 1A and 1B show different conductors and different terminals.
Figure 1A:
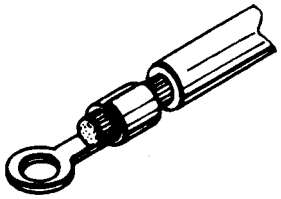
FIG. 1A PRIOR ART
Figure 2B:
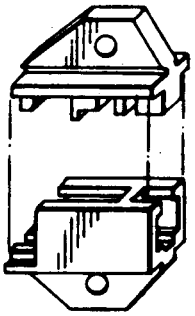
FIG. 2B PRIOR ART
FIGS. 2A–2B show different types of jaws used to pinch the conductor.
Figure 2A:
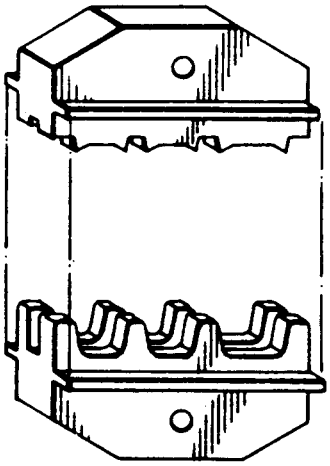
FIG. 2A PRIOR ART

A first jaw member 21 has a portion 21*a* inserted between the front portions of the handle plates 10 and secured thereto by means of a fastener A which passes through holes 101 of the handle plates 10. A second jaw member 22 is secured to the head plates 111 by means of a fastener A which passes through holes 1111 of the head plates 111. Although the jaw members 21 and 22 are of the type used for pinching a single wire, the invention is not limited thereto. Any one of the types shown in FIGS. 2A and 2B can be attached to the clamping members of the crimp tool.

The head plate members 111 are normally urged to a releasing position relative to the front portion of the handle member 10, and the second handle members 112 are urged to move away from the first handle members 10. The means for urging the second handle members 112 includes a spring 31 cooperatively connected with a ratchet-and-pawl mechanism.

A ratchet-and-pawl mechanism includes a ratchet member 30 which has a pin hole 301. A pin C which is provided with a threaded bore Cl passes through the holes 1113 of the head plates 111 and the holes 1121 of the handle plates 112, thereby pivoting the head plates 111 to the handle plates 112. Another pin Y passes through another hole 302 of the ratchet member 30 and holes 104 of the handle plates 10. Pin Q passes through pin hole 301 and holes 1124 of the handle plates 112.

A pin S is positioned in holes 105 of the handle plate 10. A hooking end 312 of the spring 31 engages with the pin S and another hooking end 311 engages with a hook portion 303 of the ratchet member 30. A pawl 32 is pivoted to the handle plates 112 by means of a pin M which passes through holes 1122. An extension spring 33 is connected to the pawl 32 with an end 331 thereof. Another end 332 of the spring 33 is secured to a pin N which is positioned in holes 1123 of the handle plate 112. The pawl 32 engages with the teeth of the ratchet member 30 by means of the end 323 thereof when the handle plates 112 are pressed toward the handle plates 111. The engagement of the ratchet member and the pawl prevent the handle plate members 112 from moving away from the handle plate members 10. When the pawl 32 reaches the notch 303 of the ratchet member 30, the pawl 32 disengages from the ratchet member 30, thereby permitting the handle plate member 112 to move away from the handle plate members 10. The distance of the notch 303 from the handle plate members 10 can be adjusted by means of an adjustment mechanism 3 so that the pawl 32 disengages from the ratchet member 30 only when the object between the head plates 111 and the front portion of the handle plates 10 is crimped sufficiently.

The adjustment mechanisms 3 are respectively provided on two sides of the second handle plates 112. Each mechanism 3 includes a knurled hollow knob 34 with a flanged end 341 forming a substantially hexagonal cross-section, a compression spring 345 received in the hollow knob 34, and a pin member 343 which passes through the compression spring 345 and threaded into the bore C1 of the pin C. The hollow knob 34 is rotatable relative to the pin member 343 and the spring biases the hollow knob 34 so that the flanged end 341 abuts against the handle member 112. The side of the hexagonal flanged end 341 are at different radial distant from the axis of the pin C. Engagement ridges 347 are formed on the handle plates 112 near the hole 1121 so as to engage with the flanged end 341. The hollow knob 34 can be pulled outward against the action of the spring 345 so as to disengage the flanged end 341 from the engagement ridge 347. The position of the flanged end 341 of the hollow knob 34 is changed when the hollow knob is rotated and the position of the pivot pin C is thus changed in the oblong hole 1121. The pivot pin C is held in position when one side of the flanged end 341 re-engages with the ridge 347.

The second handle plates 112 are normally urged to move away from the first handle plates 10 due to the tension spring 31 which pulls forward the upper end of the ratchet plate 30. As the upper end of the ratchet plate is pulled, the lower portion of the ratchet plate moves rearward and upward, thereby moving the pin Q rearward and upward along a curved path and also moving the pin C rearward without moving it upward so that the head plate 111 is moved away from the front portion of the handle plates 10.

When the handle 112 and the handle 10 are squeezed together, the head 111 is moved to the crimping position. As the handle 112 moves to the handle plates 10, the pawl 32 engages the teeth formed on a curved section of the edge of the ratchet plate 30 to provide a higher crimping pressure between the jaws 21, 22 and to prevent the handles 10, 112 from being separated by the action of the spring 31 on the ratchet plate 30. When sufficient squeezing force has been applied to the handles to cause the pawl to reach the notch 303, the paul rotates away from its teeth-engaging orientation, enabling the handles to move away from each another.

The adjustment of the adjustment mechanism 3 is now explained with reference to FIGS. 5A to 5C. The flange 341 of adjustment knob 34 is normally urged to abut with ridge 347 on the handle plate 112 because the handle plates 112 tend to move slightly forward when squeezed towards the handle plate 10, thereby causing the pin C to contact the rearmost edge of the hole 1121. The knob 34 can be turned when it is pulled outward to disengage the flange 341 from the ridge 347.

When, for example, the knob 34 is turned so that ridge 347 is contacted by the flange 341 at the shortest radial distance form the axis of the pin C, the pin C is positioned adjacent to the rearmost edge of the hole 1121 as shown in FIG. 5B. By contrast, the pin C is pushed to the foremost edge of the hole 1121 when the knob 34 is rotated so that the ridge 347 is contacted by the flange 341 located at the farthest radial distance from the axis of pin C.

The adjustment of the position of the pin C, as described above, directly affects the position of the front end portion of the head 111 when the jaws are closed. As described below, a second adjustment mechanism 4 adjusts the position of a pin T, and the position of the intermediate portion of the head plate 111, to maintain the crimping faces of the upper and lower jaws in parallel.

The adjustment mechanism 4 is employed to cooperate with the adjustment mechanism 3 by adjusting the position of a pin T to thereby adjust the vertical spacing between midregions of the opposing jaws. Thus, when the position of the intermediate portion of the head 111 is adjusted via adjustment 4, the front portion thereof can also adjusted via adjustment mechanism 3 to maintain the parallel relationship. When, for example, a wire of small cross-section is crimped, the pin T is adjusted to a higher position and the pin C is adjusted to the rearmost position. When a wire of larger cross-section is crimped, the pin T is adjusted to a lower portion and the pin C is adjusted to move to the foremost position.

An adjusting mechanism 4 includes an L-shaped adjustment rod 40 provided between the front portions of the handle plates 10. The adjustment mechanism 4 has a threaded portion 40*a* and an enlarged angled portion 40*b* which is provided with a hole 40C through which the pin T passes. A rectangular slot 103 is provided in each handle plates 10. Two knurled nuts 41, 42 are sleeved on the threaded portion 41. The nut 42 is received in the slot 103 and the nut 41 abuts with the edge of the head plates 111. The pin T is movable in the pivot holes 102 of the second handle and can be adjustably positioned between the lowest and highest positions by turning the nut 41.

When the pin T is adjusted to be at the highest position shown in FIGS. 5D, 5E, the jaws of the crimp tool is suitable for crimping a conductor with a small cross-section. In case the pin T is adjusted to be at the lowest position shown FIG. 5F, a conductor with a large cross-section can be crimped It can be appreciated that the invention provides an effective crimping of both small and large cross-section conductors since the jaw members in the invention are adjustable so as to keep the clamping faces thereof in a parallel position or a closely parallel position.

Figure 6:
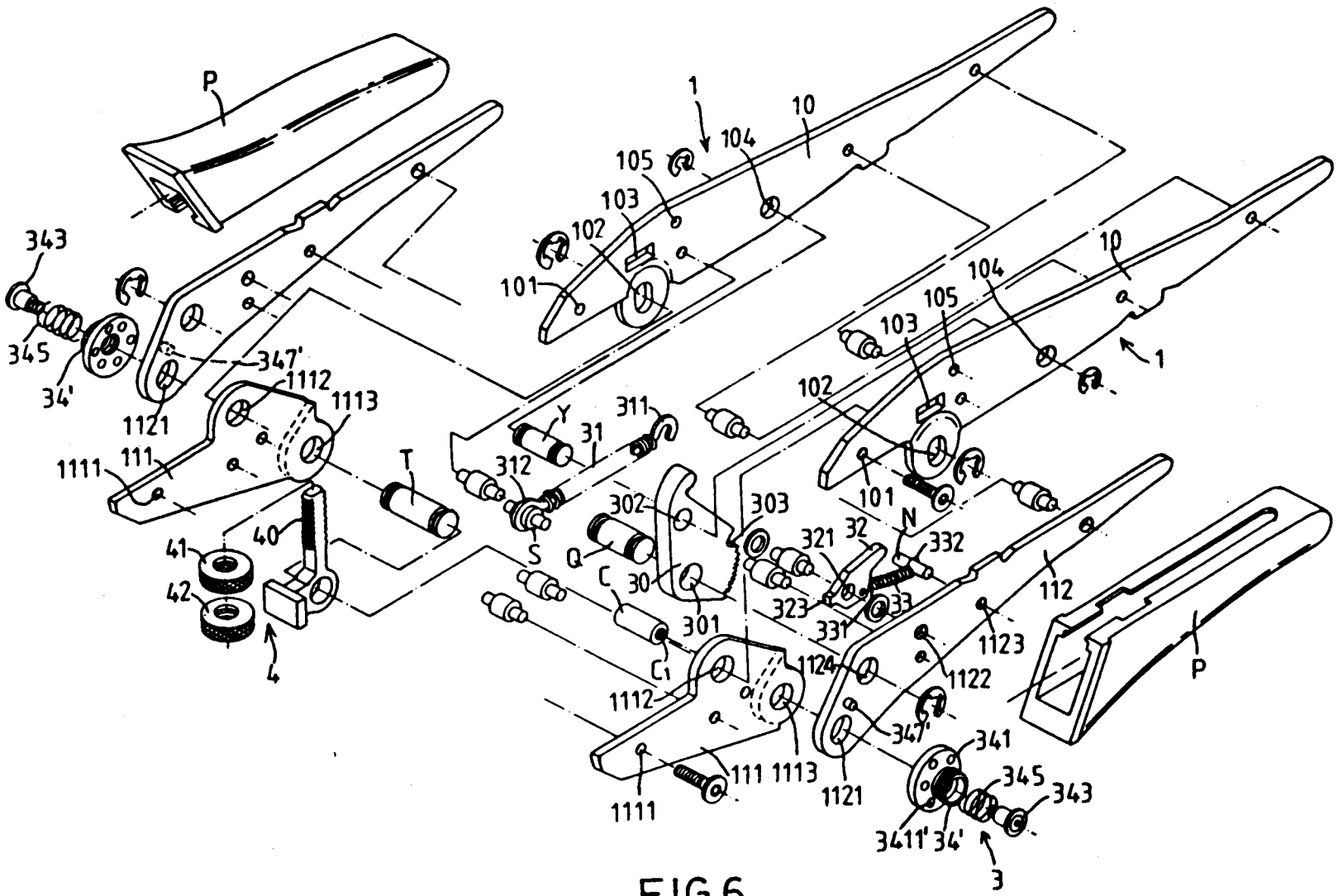
FIG. 6 shows an exploded view of the crimp tool which incorporates another embodiment of the present invention.

FIG. 6 shows another embodiment of the crimp tool which differs from the previous embodiment in that the adjustment mechanism 3' has a hollow rotary adjustment knob 34' which has an annular flanged end 341'. The annular flanged end is provided with a plurality of holes 3411' at different radial distances from the axis of the pin member 343. A cylindrical boss is formed integrally with the handle plates 112 to selectively engage with the holes 3411'. This adjustment mechanism provides the same effect as the adjustment mechanism 3.

In summary, the jaw plate 111 is coupled to the long handle 10 via pin T, which extends through holes 102, 1112, 40C, 1112 and 102 as shown in FIGS. 3 and 4. The lower handle 112 is coupled to the lower jaw 111 via pin C, which extends through holes 1121, 1113, 1113, 1121.

The ratchet plate 30 is coupled to the lower handle 112 via pin Q, which extends through holes 1124, 1113, 1113, 1124, and to the upper handle via pin Y, which extends through the holes 104, 302, 104. The ratchet plate 30 is urged counterclockwise by the tensioned spring 31.

As the handles 10, 112 are squeezed together, the handle 112 rotates counterclockwise about the pin C, the lower jaw 111 rotates clockwise about the pin T to meet the upper jaw, the pin C moves downward and the pin Q moves upward and forward. Thus, the ratchet plate 30 rotates clockwise against the spring 31.

When the jaws are fully closed, the hook 323 of the pawl enters the notch 303 of the ratchet plate, so that the spring can rotate the ratchet plate counterclockwise.

To adjust the jaws for various sized wires, mechanisms 3, 4 cooperate. With respect to adjustment mechanism 4, the "L" shaped member 40 has a hole 40C through which the pin T fits. The nuts 40, 41 adjust the pin T up or down, thereby changing the vertical spacing between the fully closed jaws. With respect to adjustment mechanism 3, the position of the pin C is adjusted via the eccentric nut 341 which pushes against ridge 347 on the handle and moves the pin C via the screw 343 that extends into the pin C. The movement is transmitted to lower jaw 111 via the contact between pin C and the inner wall of the holes 1113 through which the pin extends.

With the invention thus explained, it is apparent that various modifications and variations can be made without departing from the scope of the invention. It is therefore intended that the invention be limited only as indicated in the appended claims.

What I claim is:

1. A crimping tool comprising:

an elongated first handle member having a front portion and a rear portion, said front portion having a first pivot hole which is oblong is a transverse direction relative to said first handle member, said oblong hole defined by major and minor axes, a head member pivoted to said front portion for moving between a clamping position and a releasing position with respect to said front portion, said head member having a second pivot hole aligned with said first pivot hole and further having a third pivot hole offset from said second pivot hole, a first pivot pin member passing through said first and second pivot holes and being movable along the major axis in said oblong first pivot hole, a second elongated handle member pivoted to said head member for moving away from and towards said rear portion of said first handle member, said second handle member having a fourth pivot hole to be aligned with said third pivot hole, said fourth pivot hole being oblong substantially in the longitudinal direction of said head member, said oblong hole defined by major and minor axes, a second pivot pin passing through said third and fourth pivot holes and being movable along said major axis in said fourth oblong pivot hole, two jaw members attached to said front portion and said head member, a first screw adjustment means connected to said first pivot pin member and said front portion so as to adjust the position of said first pivot pin member, a ratchet plate connected to said first handle member adjacent to said front portion as well as to said second handle member adjacent to said third pivot hole, said ratchet plate having an edge bridging said first and second handles, said edge having a curved toothed section, a spring connected to said ratchet plate and said front portion of said first handle and urging said ratchet plate to a position that causes said jaw members to open, a pawl member resiliently mounted on said second handle member for engaging with said curved toothed section when said second handle member is moved to said first handle member, and a second adjustment means having a rotary knob connected to said second pivot pin, said rotary knob being rotatable about the axis of said pivot pin and having a flange end of polygonal cross-section which has at least two sides at different radial distances from said second pivot pin axis, said second adjustment means further having an engaging means formed on said second handle member adjacent to said rotary knob for selectively engaging with said two sides of said flanged end, said second pivot pin being thereby adjustably positioned at different positions along said major axis in said fourth oblong pivot hole upon engagement of said sides of said flanged end and said engaging boss.

2. A crimp tool as claimed in claim 1, wherein said flanged end has a hexagonal cross-section.

3. A crimp tool as claimed in claim 2, wherein said second pivot pin is a hollow member having a threaded axial bore and two open ends, and a headed insert pin screwed to each of said open ends, said second adjustment means having two said rotary knobs each of which is sleeved on each of said open ends inwardly of said headed insert pin, said flanged end of each of said rotary knobs being biased inward from said headed insert pin.

* * * * *